US010932030B2

(12) United States Patent
Konagai et al.

(10) Patent No.: US 10,932,030 B2
(45) **Date of Patent: *Feb. 23, 2021**

(54) HEADPHONES

(71) Applicant: YAMAHA CORPORATION, Hamamatsu (JP)

(72) Inventors: Yusuke Konagai, Hamamatsu (JP); Hideyoshi Masui, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/896,704

(22) Filed: Jun. 9, 2020

(65) Prior Publication Data

US 2020/0304904 A1 Sep. 24, 2020

Related U.S. Application Data

(63) Continuation of application No. 16/562,685, filed on Sep. 6, 2019, now Pat. No. 10,735,849, which is a (Continued)

(51) Int. Cl.
*H04R 1/10* (2006.01)

(52) U.S. Cl.
CPC ..... *H04R 1/1083* (2013.01); *H04R 1/1016* (2013.01); *H04R 1/1041* (2013.01)

(58) Field of Classification Search
CPC ... H04R 1/1083; H04R 1/1016; H04R 1/1041
See application file for complete search history.

(56) References Cited

U.S. PATENT DOCUMENTS 9,050,212 B2 6/2015 Gauger, Jr.
9,466,281 B2 10/2016 Hoang Co Thuy
(Continued)

FOREIGN PATENT DOCUMENTS

JP H0236297 U 3/1990
JP 2010183451 A 8/2010
(Continued)

OTHER PUBLICATIONS

International Search Report issued in Intl. Appln No. PCT/JP2017/009798 dated Jun. 6, 2017. English translation provided.
(Continued)

*Primary Examiner* — Andrew L Sniezek
(74) *Attorney, Agent, or Firm* — Rossi, Kimms & McDowell LLP

(57) ABSTRACT

Headphones include a first microphone configured to receive ambient sound at an outside of an external auditory canal of a user; a second microphone configured to receive sound inside the external auditory canal; a speaker configured to output sound toward the external auditory canal; a determiner configured to determine whether or not wind noise has occurred by comparing a first signal based on the sound received the first microphone with a second signal based on the sound received by the second microphone; and a processor configured to output, to the speaker, a signal obtained by adding an input signal to the first signal when the determiner determines that wind noise has not occurred.

14 Claims, 6 Drawing Sheets

Related U.S. Application Data continuation of application No. PCT/JP2017/009798, filed on Mar. 10, 2017.

(56) References Cited

U.S. PATENT DOCUMENTS

| | | | | |
|---|---|---|---|---|
| 9,466,311 | B2 | 10/2016 | Ono | |
| 9,467,769 | B2 | 10/2016 | Liu | |
| 10,349,163 | B2 | 7/2019 | Asada | |
| 10,652,648 | B2 * | 5/2020 | Masui | G10K 11/17873 |
| 10,735,849 | B2 * | 8/2020 | Konagai | H04R 1/1083 |
| 2010/0202621 | A1 | 8/2010 | Murata | |
| 2016/0126914 | A1 | 5/2016 | Voix | |
| 2018/0132036 | A1 | 5/2018 | Termeulen | |
| 2018/0176681 | A1 | 6/2018 | Asada | |
| 2018/0240453 | A1 | 8/2018 | Shibuya | |
| 2020/0020313 | A1 | 1/2020 | Hua | |

FOREIGN PATENT DOCUMENTS

| | | | |
|---|---|---|---|
| JP | 2015524224 | A | 8/2015 |
| JP | 2015219527 | A | 12/2015 |
| JP | 2015233200 | A | 12/2015 |
| JP | 2016500994 | A | 1/2016 |
| WO | 2016167040 | A1 | 10/2016 |
| WO | 2017038260 | A1 | 3/2017 |

OTHER PUBLICATIONS

Written Opinion issued in Intl. Appln. No. PCT/JP2017/009798 dated Jun. 6, 2017.

Notice of Allowance issued in U.S. Appl. No. 16/562,685 dated Mar. 30, 2020.

* cited by examiner

HEADPHONES

CROSS REFERENCE TO RELATED APPLICATIONS

This Application is a continuation application of PCT Application No. PCT/JP2017/009798, filed Mar. 10, 2017, the entire contents of which are incorporated herein by reference.

BACKGROUND

Technical Field

The present disclosure relates to headphones that allow a user to perceive ambient sounds.

Background Information

In recent years, portable playback devices, such as smartphones, are in wide use. A user of a playback device wears headphones indoors and outdoors in order to listen to sounds based on a signal output from the playback device. A user who wears headphones outdoors needs to hear not only sounds based on the signal output from the playback device, but also needs to hear ambient sounds, in various situations.

Therefore, a technique has been proposed in which a microphone for receiving ambient sounds is provided in headphones in order to allow the user to hear both ambient sounds received by the microphone and sounds based on the signal output from the playback device (for example, refer to Japanese Patent Application Laid-Open Publication No. 2010-183451).

However, in a technique in which ambient sounds are received outdoors by the microphone, a windshield such as a windjammer and a windscreen needs to be provided for the microphone in order to reduce unpleasant wind noise. The windshield described above can reduce wind noise very effectively. However, the windshield has a drawback in that the windshield is large, and a further drawback is that the windshield degrades the design of the headphones.

SUMMARY

The present disclosure has been made in view of such circumstances. An object of the present disclosure is to provide a technique in which no windshield is required for headphones that include a microphone for receiving ambient sound.

In order to achieve the above object, headphones according to an aspect of the present disclosure includes a first microphone configured to receive ambient sounds outside an external auditory canal of a user, a second microphone configured to receive sound inside the external auditory canal, a speaker configured to output sound toward the external auditory canal, a determiner configured to determine whether or not wind noise has occurred by comparing a first signal based on the sound received by the first microphone with a second signal based on the sound received by the second microphone, and a processor configured to output, to the speaker, a signal obtained by adding an input signal to the first signal when the determiner determines that the wind noise has not occurred.

DESCRIPTION OF EMBODIMENTS

Hereinafter, embodiments according to the disclosure will be described with reference to the drawings.

Figure 1:
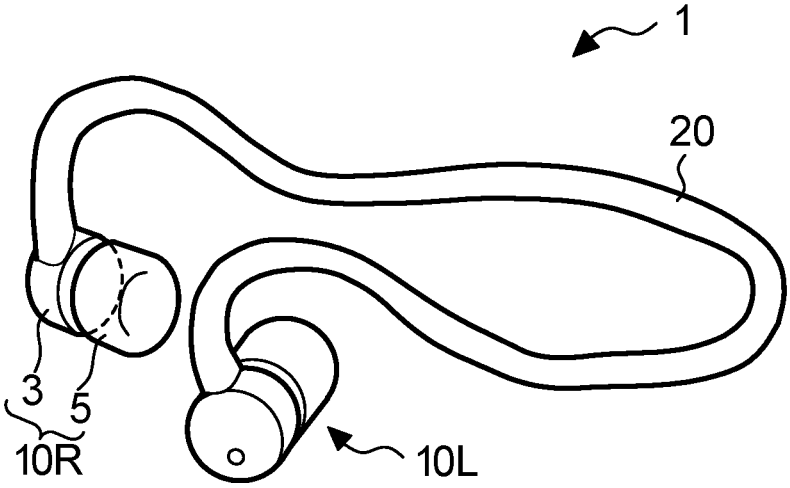
FIG. 1 shows headphones according to a first embodiment.

FIG. 1 is a view showing headphones 1 according to a first embodiment. The headphones 1 include a right unit 10R for a right ear, a left unit 10L for a left ear, and a neckband 20 that connects the right unit 10R to the left unit 10L.

The right unit 10R includes a base unit 3 and an earpiece 5. The base unit 3 is formed of a hard material such as plastic, for example. The base unit 3 is fixed to one end of the neckband 20. The external appearance of the base unit 3 is substantially cylindrical. The earpiece 5 is formed of an elastic material such as, for example, silicone rubber and urethane. The earpiece 5 is installed on the base unit 3.

Similar to the right unit 10R, the left unit 10L includes a base unit and an earpiece. Reference signs are omitted in FIG. 1 for the left unit 10L.

Figure 2:
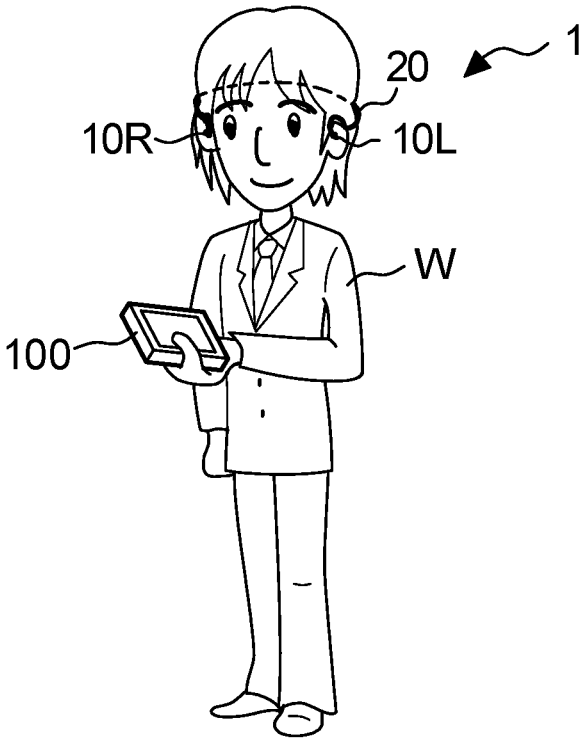
FIG. 2 shows a state of use of the headphones.
Figure 3:
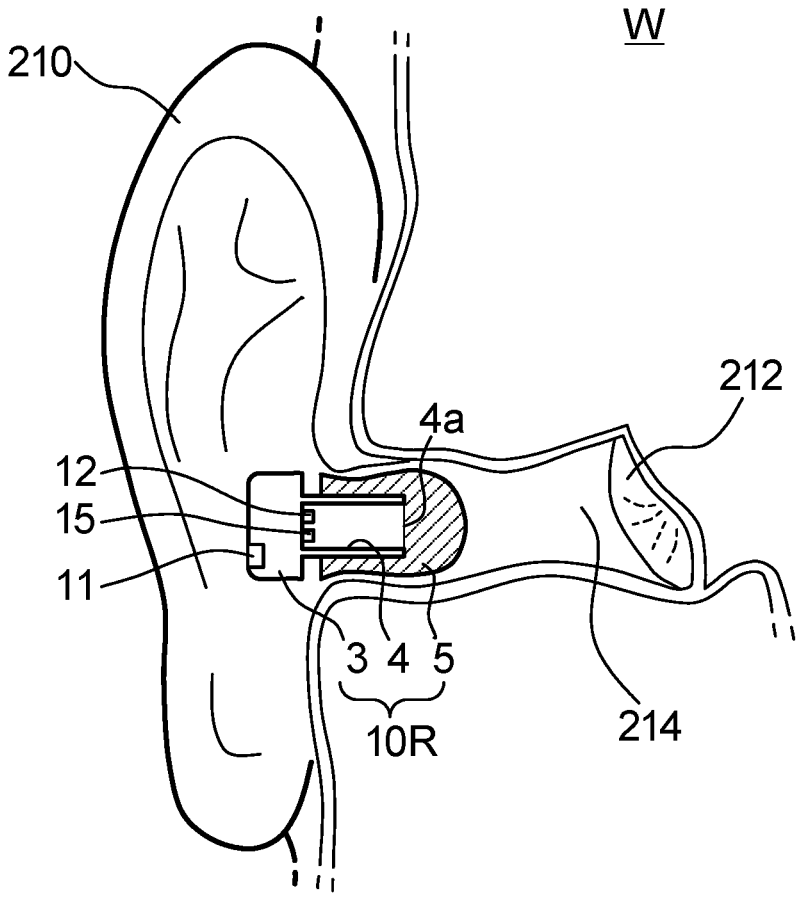
FIG. 3 is a detailed view showing the headphones in use.

FIG. 2 is a view showing the headphones 1 in a state of use. FIG. 3 is, in particular, a view showing the right unit 10R that is attached to the right ear.

A user W uses the headphones 1 as follows. As shown in FIG. 2, the user W pulls the neckband 20 behind the user's ears, with the right unit 10R and the left unit 10L positioned in front of the band 20. Then, the user W inserts the earpiece 5 of the right unit 10R into the user's right external auditory canal, and inserts the earpiece 5 of the left unit 10L into the user's left external auditory canal.

As shown in FIG. 3, a microphone 11 is provided on one of two bottom surfaces of the cylindrical base unit 3. A cylindrical port 4 having an opening 4*a* is unitarily formed with the other of the bottom surfaces. A microphone 12 and a speaker 15 are provided on the other of the bottom surfaces, which constitutes the bottom of the port 4.

The earpiece 5 is formed of an elastic material in a dome shape or a shell shape for example. The earpiece 5 is installed on the base unit 3 so as to cover the port 4 by the bottom of the earpiece 5. The tip of the earpiece 5 is inserted into the user's external auditory canal 214.

More specifically, with respect to the right unit 10R, the earpiece 5 is inserted into the user's external auditory canal 214 such that the tip of the earpiece 5 does not reach tympanic membrane 212, with one end of the base unit 3 exposed from the external auditory canal 214. In this state, the microphone 11 receives ambient sound. The microphone 12 receives the sound output from the speaker 15. The microphone 12 further receives sound in a closed space formed by closing the external auditory canal 214 with the earpiece 5. The microphone 12 further receives the ambient sound transmitted through the base unit 3 and the earpiece 5, etc.

In FIG. 3, the neckband 20 is omitted for simplicity.

The electrical configuration of the right unit 10R is almost the same as the electrical configuration of the left unit 10L, as will be described later. Therefore, the electrical configurations of the right unit 10R and the left unit 10L will be described using the right unit 10R as representative.

Figure 4:
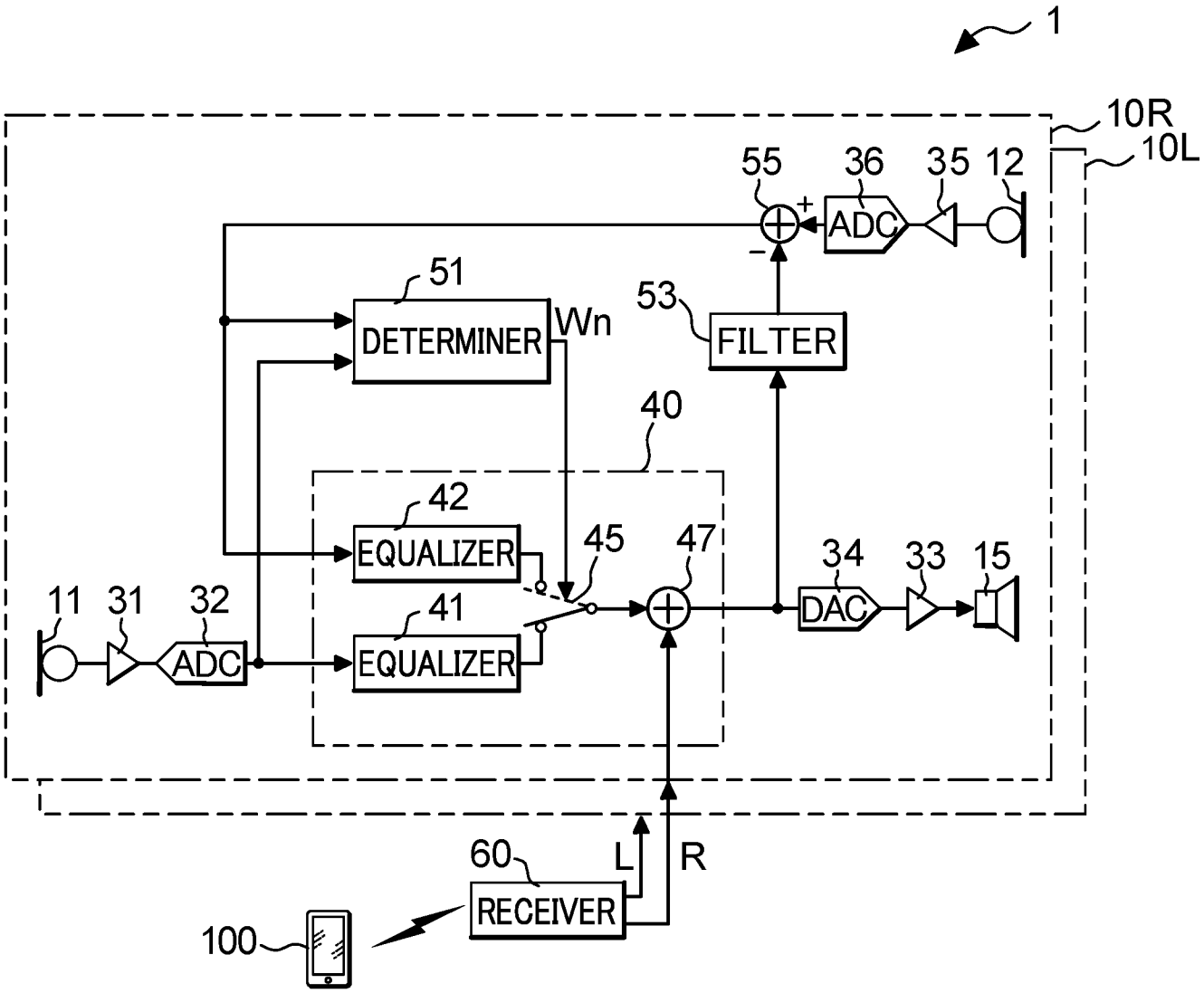
FIG. 4 is a block diagram showing an electrical configuration of the headphones.

FIG. 4 is a block diagram showing the electrical configuration of the right unit 10R.

In the right unit 10R, a signal based on sound received by the microphone 11 is amplified by an amplifier 31. The signal amplified by the amplifier 31 is subsequently converted into a digital signal by an analog-to-digital converter (ADC) 32, which is then supplied to both an equalizer 41 and a determiner 51. The output signal of the ADC 32 is an example of a first signal.

Meanwhile, in the right unit 10R, a signal based on sound received by the microphone 12 is amplified by an amplifier 35. The signal amplified by the amplifier 35 is subsequently converted into a digital signal by an ADC 36, which is then supplied to an addition input terminal (+) of a subtractor 55.

An output signal of a filter 53 is supplied to a subtraction input terminal (−) of the subtractor 55. Therefore, the subtractor 55 outputs a subtraction signal obtained by subtracting the output signal of the filter 53 from an output signal of the ADC 36. The subtraction signal is an example of a second signal. The subtraction signal is supplied to both an equalizer 42 and the determiner 51.

The filter 53 has a characteristic equivalent to a change in sound caused in a situation in which the sound propagates through a path from the speaker 15 to the microphone 12 in the external auditory canal 214. The characteristic is determined based on a simulated result of the path. More specifically, the filter 53 imparts, to the signal output to the speaker 15, a component based on the change (due to reflection and attenuation of sound, and the like) caused in the situation in which the sound output by the speaker 15 propagates through the path. The subtractor 55 subtracts the output signal of the filter 53 from the output signal of the ADC 36, i.e., a signal based on a sound received by the microphone 12. Accordingly, in the subtraction signal, a component of the sound output from the speaker 15 (and has reached the microphone 12) is canceled out.

The determiner 51 determines whether or not the ambient sound received by the microphone 11 includes wind noise on the basis of the output signal of the ADC 32 and the subtraction signal, to output a signal Wn indicating the determination result. The determiner 51 may be a comparator or circuitry.

Here, the determination of whether the wind noise is included will now be described.

Figure 7:
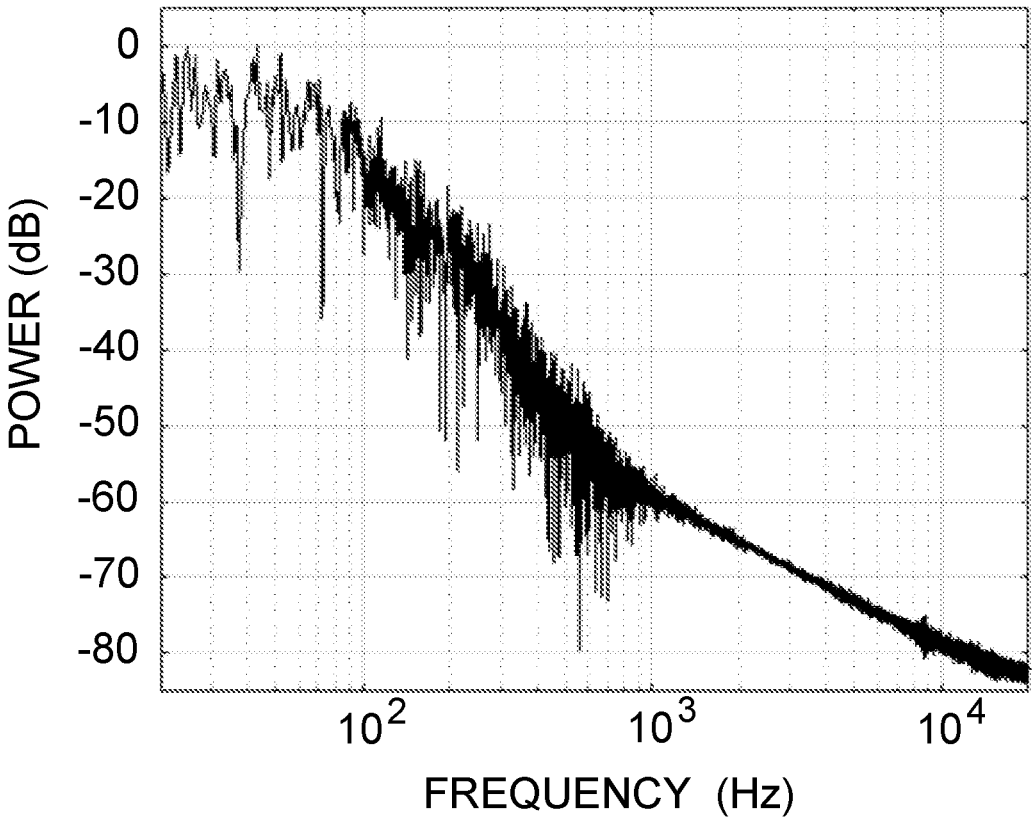
FIG. 7 is a diagram showing an example of frequency characteristics of wind noise.

FIG. 7 is a view showing an example of frequency characteristics of the wind noise.

In general, wind noise is random noise that occurs by turbulence of airflow around a microphone. Such wind noise occurs over a wide frequency band. The wind noise has frequency characteristics in which a level of the wind noise is relatively high in the low frequency band, in which the level of the wind noise is relatively low in the high frequency band, and in which the level of the wind noise gradually decreases in accordance with an increase of the frequency of the wind noise. Since the wind noise occurs by turbulence in airflow, the wind noise may vary according to structure and material of the base unit 3.

In the embodiment, when wind noise occurs, the microphone 11 directly receives the wind noise together with the ambient sound. The earpiece 5 is inserted into the external auditory canal 214 of the user W in a state of use. In such a state, the microphone 12 does not directly receive the wind noise, but it indirectly receives both the ambient sound and the wind noise to a greater or lesser extent, through the base unit 3 or the ear of user W. A sound path to the microphone 11 and a sound path to the microphone 12 will be described later.

As described above, the wind noise and the ambient sound are directly received by the microphone 11, whereas they are indirectly received by the microphone 12. For this reason, when wind noise has occurred, the level of the sound in the low frequency band which is received by the microphone 11 is likely to be higher than the level of the sound in the low frequency band which is received by the microphone 12. In contrast, when the wind noise has not occurred, the level of the sound in the low frequency band which is received by the microphone 11 will not be so high, compared to the level of the sound in the low frequency band which is received by the microphone 12.

Therefore, the determiner 51 determines whether or not the level of the signal in the low frequency band which is output from the ADC 32 is greater than the level of the signal in the low frequency band which is output from the subtractor 55 by a threshold value or more. When the level of the signal in the low frequency band, which is output from the ADC 32 is greater than the level of the signal in the low frequency band, which is output from the subtractor 55 by the threshold value or more, the determiner 51 determines that wind noise has occurred. On the other hand, when the level of the signal in the low frequency band which is output from the ADC 32 is not greater than the level of the signal in the low frequency band which is output from the subtractor 55 by the threshold value or more, the determiner 51 determines that no wind noise has occurred.

The determiner 51 outputs the signal Wn at an H level when the determiner 51 determines that the wind noise has occurred. On the other hand, the determiner 51 outputs the signal Wn at an L level when the determiner 51 determines that no wind noise has occurred.

Various methods for detecting wind noise can be considered, as will be described later, in addition to the method described above.

A processor 40 includes the equalizers 41 and 42, a switch 45, and an adder 47. The equalizer 41 performs a correction process on the output signal of the ADC 32, for example, a process of adjusting sound quality.

The equalizer 42 performs a process of emphasizing the subtraction signal in the high frequency band in addition to a correction process equivalent to that of the equalizer 41. The microphone 12 does not directly receive ambient sound, but indirectly receives ambient sound via the base unit 3, the earpiece 5, the ear of user W, and the like, as described above. For this reason, the ambient sound received by the microphone 12 is not clear, particularly in the high frequency band. Therefore, the equalizer 42 performs a correction process of emphasizing the subtraction signal in the high frequency band.

When the signal Wn is at the L level, that is, when the determiner 51 determines that no wind noise has occurred, the switch 45 selects an output signal of the equalizer 41 (the switch 45 takes a position indicated by the solid line in FIG. 4).

On the other hand, when the signal Wn is at the H level, that is, when the determiner 51 determines that wind noise has occurred, the switch 45 selects an output signal of the equalizer 42 (the switch 45 takes a position indicated by the broken line in FIG. 4).

The switch 45 supplies the output signal of the equalizer selected from among the equalizers 41 and 42 to one of the input terminals of the adder 47.

A receiver 60 is used to receive a sound signal of sound that is heard by the user W with the headphones 1. The receiver 60 is incorporated into the inside of the neckband 20, for example. The receiver 60 receives a stereo signal reproduced by a playback device 100, for example, wirelessly. The playback device is, for example, a smartphone or the like. The receiver 60 supplies an R signal in the stereo signal to the other input terminal of the adder 47 in the right unit 10R.

The receiver 60 supplies an L signal in the stereo signal output from the playback device 100 to the left unit 10L.

In an alternative configuration, the receiver 60 may be incorporated into one of the right unit 10R and the left unit 10L instead of the neckband 20. The receiver 60 may receive the stereo signal from the playback device 100 using a wire instead of receiving the signal wirelessly.

In the right unit 10R, the adder 47 generates a sum signal by adding a signal selected by the switch 45, to the R signal received by the receiver 60. The adder 47 supplies the sum signal to both a digital-to-analog converter (DAC) 34 and the filter 53. The sum signal is a digital signal. In a case in which the switch 45 selects the equalizer 41, the sum signal is obtained by adding the output signal of the equalizer 41 to the R signal. In a case in which the switch 45 selects the equalizer 42, the sum signal is obtained by adding the output signal of the equalizer 42 to the R signal.

The DAC 34 converts the sum signal into an analog sum signal. An amplifier 33 amplifies the analog sum signal and supplies the amplified signal to the speaker 15. The speaker 15 converts the analog sum signal amplified by the amplifier 33 into physical vibration, that is, sound, and outputs the sound.

When the headphones 1 are used, the earpiece 5 is inserted into the external auditory canal 214 of user W. Therefore, the sound output from the speaker 15 reaches the tympanic membrane 212 of user W and is perceived as sound. Meanwhile, the sound from the speaker 15 is received by the microphone 12, and is reflected and decreased inside the external auditory canal 214.

In the embodiment, in a case in which the determiner 51 determines that wind noise has not occurred, in the right unit 10R for the right ear, the speaker 15 outputs the sound based on the output signal of the adder 47. In this case, the output signal of the adder 47 is generated by adding the output signal of the equalizer 41, which is a signal based on ambient sound, to the R signal from the playback device 100. Therefore, the user W wearing headphones 1 can listen to the played sound based on a signal from the playback device 100 while being able to hear ambient sounds.

In a case in which the determiner 51 determines that wind noise has occurred, in the right unit 10R for the right ear, the speaker 15 outputs the sound based on the output signal of the adder 47. In this case, the output signal of the adder 47 is generated by adding the output signal of the equalizer 42 to the R signal output from the playback device 100, where the output signal of the equalizer 42 is obtained by performing the correction process of emphasizing the subtraction signal in the high frequency band. Accordingly, the wind noise can be reduced in the sound output from the speaker 15. Therefore, the user W can listen to stereo sound based on the signal output from the playback device 100 while clearly perceiving ambient sounds.

It is of note that, although the right unit 10R for the right ear is described here, the left unit 10L for the left ear has the same configuration as that of the right unit 10R except for the following point. Specifically, in the left unit 10L, the earpiece 5 is inserted into the user's left external auditory canal 214. The L signal of signals received by the receiver 60 is supplied to the other input terminal of the adder 47.

Figure 5:
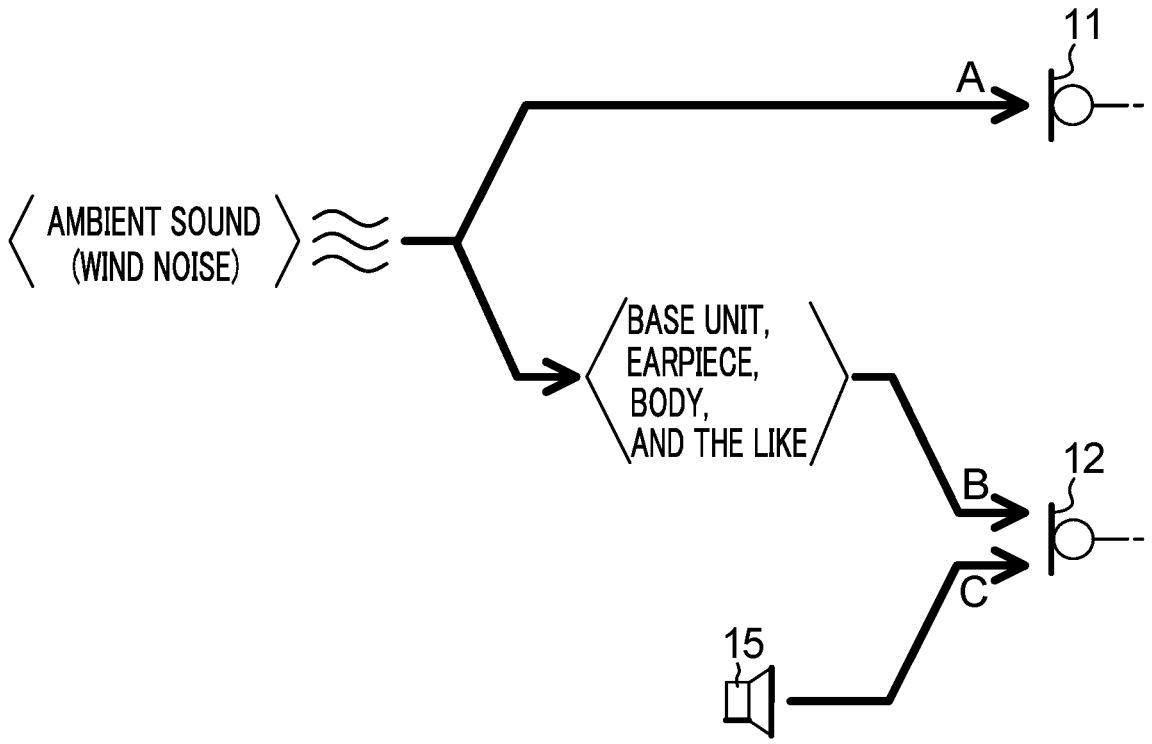
FIG. 5 is an explanatory diagram for paths of sound transmitted to microphones in the headphones.

FIG. 5 is a view showing a sound path to the microphone 11 and a sound path to the microphone 12.

If wind noise has occurred, ambient sound is received together with the wind noise by the microphone 11, as shown by path A in the drawing. Similarly, if wind noise has occurred, ambient sound is received together with the wind noise by the microphone 12 through the base unit 3, the earpiece 5, and the body of user W, etc., as shown by path B. On the other hand, the sound output by the speaker 15 is changed due to reflection and attenuation of the sound at the external auditory canal 214. The microphone 12 receives the altered sound, as shown by path C in the drawing. The microphone 12 thus receives the sound output by the speaker 15 and the ambient sound which is transmitted through the base unit 3, the earpiece 5, and the like. The subtraction signal does not include a sound component output by the speaker 15 or a component of the change due to the reflection and attenuation as described above. Therefore, the subtraction signal represents the ambient sound, which is transmitted through the earpiece 5 and the like.

In each of the right unit 10R and the left unit 10L, the presence or absence of wind noise is determined separately. Therefore, for example, when one of the right unit 10R and the left unit 10L is located upwind and the other is located downwind, it might be determined that wind noise has occurred at one of the units and that no wind noise has occurred at the other unit.

In this way, the user W wearing the headphones 1 according to the embodiment can listen to the stereo sound based on the signal reproduced by the playback device 100 while perceiving the ambient sound if no wind noise has occurred. Even when wind noise has occurred, the wind noise can be reduced in the sound output by the speaker 15. Therefore, the user W can listen to stereo sound based on the signal played by the playback device 100 while clearly perceiving ambient sounds.

It is of note that, in the embodiment, when the determiner 51 determines that no wind noise has occurred, the output signal of the ADC 32 is corrected by the equalizer 41. However, the correction process in the equalizer 41 does not have to be performed.

When the determiner 51 determines that wind noise has occurred, the subtraction signal is corrected by the equalizer 42. However, when the high frequency band of the ambient sound received by the microphone 12 is clear, the correction process in the equalizer 42 does not have to be performed.

Next, a second embodiment will be described. Headphones 1 according to the second embodiment differ from the headphones according to the first embodiment only in electrical configuration. The second embodiment will be described focusing on the electrical configuration.

Figure 6:
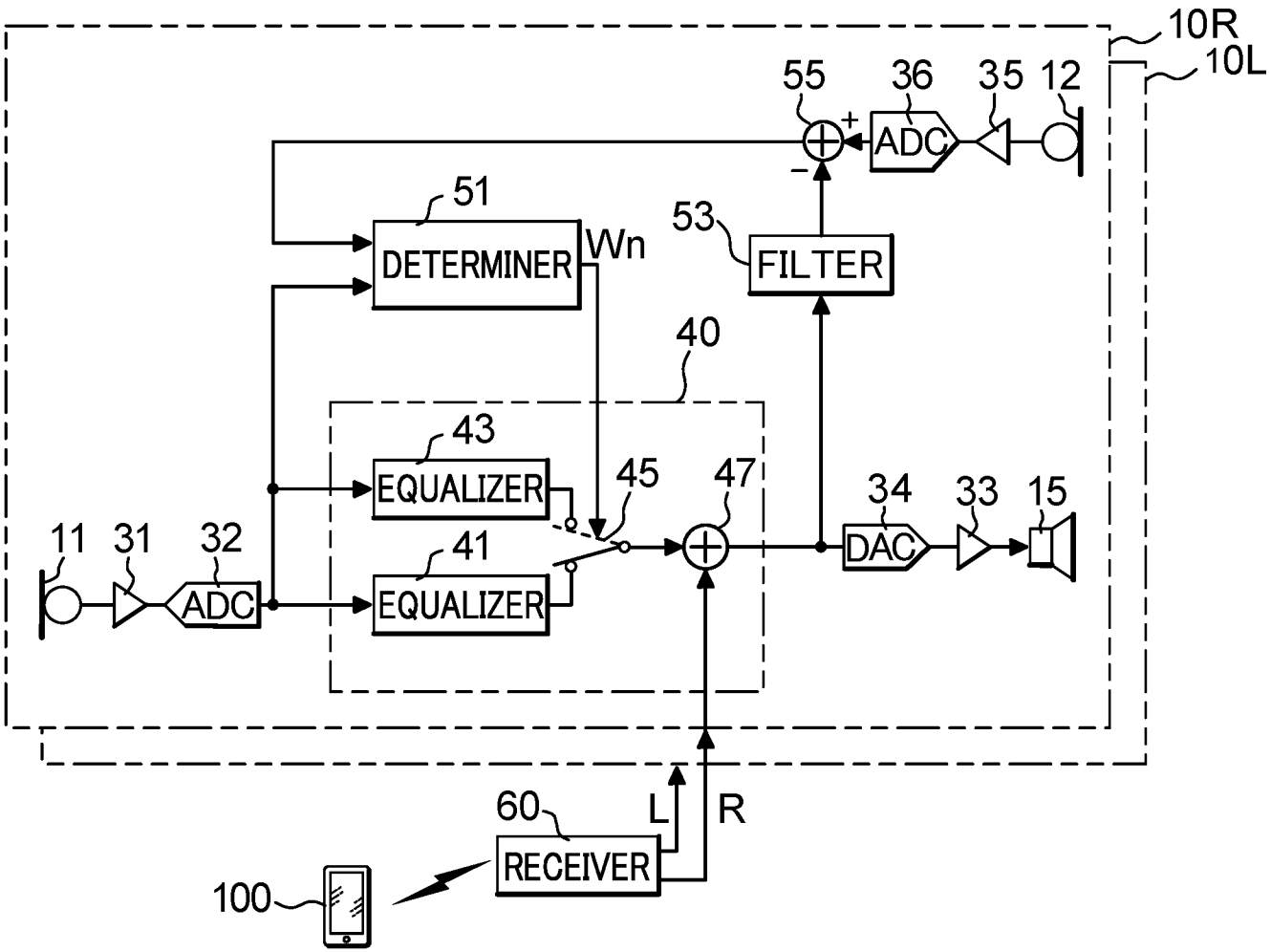
FIG. 6 is a block diagram showing an electrical configuration of headphones according to a second embodiment.

FIG. 6 is a view showing headphones 1 according to the second embodiment. The configuration shown in FIG. 6 differs from the configuration shown in FIG. 4 in the following three points: 1) the equalizer 42 in the processor 40 is replaced with an equalizer 43 that is different from the equalizer 42 in characteristics (a first point); 2) the subtraction signal is not supplied to the processor 40 but is supplied only to the determiner 51 (a second point); and 3) the output signal of the ADC 32 is supplied to the equalizer 43 in addition to the determiner 51 and the equalizer 41 (a third point).

From among the above three points, the first point will be described. The equalizer 43 performs a correction process on the output signal of the ADC 32. In detail, in addition to a correction process similar to the correction process in the equalizer 41, the equalizer 43 performs a process of reducing a component in a frequency band of the wind noise. As described with reference to FIG. 7, the wind noise has a frequency characteristic in which the level of the wind noise is relatively high in the low frequency band, in which the level of the wind noise is relatively low in the high frequency band, and in which the level of the wind noise gradual decreases in accordance with increase in the frequency of the wind noise. Therefore, when the equalizer 43 reduces a component in the low frequency band to within the frequency range of the wind noise, wind noise output from the speaker 15 may be reduced.

In the headphones 1 according to the second embodiment, the switch 45 selects the output signal of the equalizer 41 when the wind noise has not occurred. In this case, the operation of the headphones 1 according to the second embodiment is the same as the operation of the headphones 1 according to the first embodiment. That is, in the right unit 10R for the right ear, when no wind noise has occurred, the speaker 15 outputs the sound based on the output signal of the adder 47. In this case, the output signal of the adder 47 is generated by adding the output signal of the equalizer 41 to the R signal of the stereo signal from the playback device 100.

On the other hand, when the wind noise occurs, the switch 45 selects an output signal of the equalizer 43. Therefore, in the right unit 10R for the right ear, the speaker 15 outputs a sound based on the output signal of the adder 47. In this case, the output signal of the adder 47 is generated by adding the output signal of the equalizer 43 to the R signal of the stereo signal from the playback device 100. The output signal of the equalizer 43 represents sound with the reduced wind noise as a result of performing the correction process for reducing a component in the low frequency band of the output signal of the ADC 32, which represents sound including the wind noise.

Here, although the right unit 10R for the right ear has been described, the same applies to the left unit 10L for the left ear.

In the second embodiment, the correction process in the equalizer 43 is configured by adding the process of reducing a component in the low frequency band within the frequency range of the wind noise to the correction process in the equalizer 41. Therefore, instead of providing a configuration in which the switch 45 selects one of the output signal of the equalizer 41 and the output signal of the equalizer 43, a configuration may be provided in which, on the basis of the determination result of the determiner 51, a switch selects one of a path, through which the output signal of the equalizer 41 is sent to a separate equalizer for performing the above-described reduction process on the output signal of the equalizer 41, and a path through which the output signal of the equalizer 41 is not sent to the separate equalizer.

Further, a plurality of equalizers may be provided, that are different from each other in degree in reducing the component in the low frequency band within the frequency range of the wind noise. From among the plurality of equalizers, the determiner 51 may determine one equalizer that is selected by the switch 45 according to the level of the wind noise. In this case, the determiner 51 may determine parameters, which prescribe the process performed in the equalizer 43, according to the level of the wind noise.

In the first and second embodiments, the right unit 10R and the left unit 10L are connected to each other by the neckband 20. However, they may be connected to each other by a headband. The right unit 10R and the left unit 10L may be electrically connected to each other wirelessly so as to eliminate a physical connection, such as the neckband.

The first embodiment and the second embodiment have been described as a set of headphones that outputs stereo sound. However, a monaural earphone or an earphone for only one ear may be used as long as the earphone allows the user to perceive both the sound based on the signal from the playback device 100 and ambient sound with the wind sound reduced.

The way the determiner 51 determines whether or not the wind noise occurs can be determined by the following method other than the method described in the first embodiment.

The wind noise has a frequency characteristic in which the level of the wind noise is relatively high in the low frequency band, in which the level of the wind noise is relatively low in the high frequency band, and in which the level of the wind noise is gradually decreased in accordance with an increase of the frequency of the wind noise, as described in FIG. 7. Therefore, for example, if the level of the signal in the low frequency band of the signal generated by the microphone 11 is equal to or higher than a threshold value, the determiner 51 may determine that wind noise has occurred.

When one of the right unit 10R and the left unit 10L in the headphones 1 is located upwind and the other is located downwind, the level of the signal based on the sound received by the microphone 11 that is located upwind is higher than the level of the signal based on the sound received by the microphone 11 that is positioned downwind.

Therefore, the level of the signal output from the microphone 11 of the right unit 10R may be compared with the level of the signal output from the microphone 11 of the left unit 10L. When a difference between the levels of the two signals is equal to or greater than a threshold value, the determiner 51 may determine that wind noise has occurred. On the other hand, when the difference is less than the threshold value, the determiner 51 may determine that no wind noise has occurred.

In this configuration, the determiner 51 may determine that the wind noise occurs in the unit that outputs the higher level of the signal, or the determiner 51 may determine that the wind noise occurs in both units.

An example of the frequency characteristic of the wind noise is as shown in FIG. 7, but since the turbulence of airflow varies according to wind direction, the frequency characteristics of the wind noise may vary according to wind direction. Therefore, the frequency characteristics of the wind noise may be measured for each wind direction and then the measurement results may be stored. The determiner 51 may determine whether or not the frequency characteristic of the signal output from the microphone 11 matches (or is close to) one of the stored frequency characteristics of the wind noise. When the frequency characteristic of the signal output from the microphone 11 matches one of the stored frequency characteristics of the wind noise, the determiner 51 determines that wind noise has occurred. On the other hand, when the frequency characteristic of the signal output from the microphone 11 does not match any of the stored frequency characteristics of the wind noise, the determiner 51 determines that no wind noise has occurred.

As a method of the determination of wind noise, the above-described methods may be used alone or in combination of two or more.

The microphone 11 or the microphone 12, or both, receive ambient sounds. Therefore, the phase of the signal output from the microphone 11 or 12 may be inverted, and then the inverted signal may be added to the signal from the playback device 100, thereby providing the function of reducing the ambient sound (noise) (so-called noise cancelling function).

From the above embodiments, the following aspects are derivable, especially, from the viewpoint of allowing a user to perceive both the sound based on the output signal of the external device and ambient sound with wind noise reduced.

First, the disclosure is understood to be headphones that include a first microphone configured to receive ambient sound at an outside of an external auditory canal of a user, a second microphone configured to receive sound inside the external auditory canal, a speaker configured to output sound toward the external auditory canal, a determiner configured to determine whether or not wind noise has occurred by comparing a first signal based on the sound received by the first microphone with a second signal based on the sound received by the second microphone, and a processor configured to output, to the speaker, a signal obtained by adding an input signal to the first signal when the determiner determines that wind noise has not occurred.

Although the first microphone may receive ambient sound together with wind noise, the second microphone is inserted into the external auditory canal and thus does not come into contact with wind in the above-described headphones. Therefore, the presence or absence of the wind noise can be determined in accordance with a result of comparison of the first signal based on the sound received by the first microphone with the second signal based on the sound received by the second microphone. Accordingly, it is not necessary to install a windshield on the first microphone.

It is of note that "output[ting] a signal to something" means that a separate intermediate element may intervene in the path to something.

In the headphones, when the determiner determines that wind noise has occurred, the processor may output, to the speaker, a signal obtained by adding an input signal to the second signal. This configuration allows the user to perceive both the sound based on the signal output from a playback device and the ambient sound with wind noise reduced.

In the headphones, when the determiner determines that wind noise has occurred, the processor may output, to the speaker, a signal obtained by adding an input signal to the first signal after performing a process of reducing noise components of the wind noise within the first signal. This configuration also allows the user to perceive both sound based on the signal output from a playback device and ambient sound with wind noise reduced.

The headphones may be configured to further include a filter configured to impart a predetermined characteristic to a signal output to the speaker and a subtractor configured to subtract an output signal of the filter from an output signal of the second microphone, wherein the determiner determines whether or not wind noise has occurred by comparing the first signal with an output signal of the subtractor. According to this configuration, a signal based on the sound output from the speaker can be canceled from the signal received by the second microphone.

DESCRIPTION OF REFERENCE SIGNS

1: Headphones, 10R: Right unit, 10L: Left unit, 11: Microphone (first microphone), 12: Microphone (second microphone), 15: Speaker, 40: Processor, 55: Subtractor, 100: External device.

What is claimed is:

1. Headphones comprising:

a first microphone configured to receive first ambient sound from outside of an external auditory canal of a user;

a speaker configured to output sound toward the external auditory canal;

determining circuitry configured to determine, in accordance with a first audio signal received from the first microphone, whether or not wind noise has occurred; and a processor configured to output, to the speaker, a first signal obtained by adding an input signal obtained from an audio source to the first audio signal in a case where the determining circuitry determines that the wind noise has not occurred.

2. The headphones according to claim 1, wherein:

the external auditory canal is a right external auditory canal of a right ear of the user, the headphones further comprises a second microphone configured to receive second ambient sound from outside of a left external auditory canal of a left ear of the user, and the determining circuitry determines that wind noise has occurred in a case where a difference between a first level of the first audio signal and a second level of a second audio signal received from the second microphone is equal to or greater than a predetermined threshold value.

3. The headphones according to claim 1, wherein, the determining circuitry determines that the wind noise has occurred in a case where a frequency characteristic of the first audio signal matches or is close to a stored frequency characteristic of the wind noise.

4. The headphones according to claim 1, wherein:

the first audio signal ranges from a first frequency band to a second frequency band having frequencies that are lower than frequencies in the first frequency band, and the determining circuitry determines that the wind noise has occurred in a case where a level of the first audio signal in the second frequency band is equal to or higher than a predetermined threshold value.

5. The headphones according to claim 1, wherein:

the headphones further comprises a second microphone configured to receive sound in the external auditory canal, and the processor, in a case where determining circuitry determines that the wind noise has occurred, outputs, to the speaker, a second signal obtained by adding the input signal to a second audio signal received from the second microphone.

6. The headphones according to claim 1, wherein the processor, in a case where the determining circuitry determines that the wind noise has occurred, outputs, to the speaker, a second signal by adding the input signal to the first audio signal that has undergone a noise reduction processing to reduce the wind noise within the first audio signal.

7. The headphones according to claim 1, wherein:

the headphones further comprises:

a second microphone configured to receive sound in the external auditory canal;

a filter configured to impart a predetermined characteristic to the first signal output to the speaker; and a subtractor configured to subtract an output signal from the filter from a second audio signal received from the second microphone, and determining circuitry determines whether or not the wind noise has occurred by comparing the first audio signal with an output signal from the subtractor.

8. A method of outputting a signal to a speaker configured to output sound toward an external auditory canal of a user, the method comprising:

receiving a first audio signal from a first microphone, the first audio signal representing first ambient sound from outside of the external auditory canal of the user;

determining, based on the first audio signal, whether or not wind noise has occurred; and outputting, to the speaker, a first signal obtained by adding an input signal obtained from an audio source to the first audio signal in a case where the determining determines that the wind noise has not occurred.

9. The method according to claim 8, wherein:

the external auditory canal is a right external auditory canal of a right ear of the user, the method further comprises receiving a second audio signal from a second microphone, the second audio signal representing second ambient sound from outside of a left external auditory canal of a left ear of the user, and the determining determines that the wind noise has occurred in a case where a difference between a first level of the first audio signal and a second level of the second audio signal is equal to or greater than a predetermined threshold value.

10. The method according to claim 8, wherein the determining determines that the wind noise has occurred in a case where a frequency characteristic of the first audio signal matches or is close to a stored frequency characteristic of the wind noise.

11. The method according to claim 8, wherein:

the first audio signal ranges from a first frequency band to a second frequency band having frequencies that are lower than frequencies in the first frequency band, and the determining determines that the wind noise has occurred in a case where a level of the first audio signal in the second frequency band is equal to or higher than a predetermined threshold value.

12. The method according to claim 8, further comprising:

receiving a second audio signal from a second microphone, the second audio signal representing sound in the external auditory canal, wherein the outputting, in a case where the determining determines that the wind noise has occurred, outputs, to the speaker, a second signal obtained by adding the input signal to the second audio signal.

13. The method according to claim 8, wherein the outputting, in a case where the determining determines that the wind noise has occurred, outputs, to the speaker, a second signal obtained by adding the input signal to the first audio signal that has undergone a noise reduction processing to reduce the wind noise within the first audio signal.

14. The method according to claim 8, further comprising:

receiving a second audio signal from a second microphone, the second audio signal representing sound in the external auditory canal;

imparting a predetermined characteristic to the first signal output to the speaker to generate a first output signal; and subtracting the first output signal from the second audio signal to generate a second output signal, wherein the determining determines whether or not the wind noise has occurred by comparing the first audio signal with the second output signal.

* * * * *